US009528259B2

(12) United States Patent
Bossom

(10) Patent No.: US 9,528,259 B2
(45) Date of Patent: Dec. 27, 2016

(54) PACKAGED LIQUID RECLAMATION SYSTEM

(71) Applicant: Federal Signal, Oak Brook, IL (US)

(72) Inventor: Bernie Jon Bossom, Streator, IL (US)

(73) Assignee: Federal Signal Corporation, Oak Brook, IL (US)

( * ) Notice: Subject to any disclaimer, the term of this patent is extended or adjusted under 35 U.S.C. 154(b) by 703 days.

(21) Appl. No.: 13/833,336

(22) Filed: Mar. 15, 2013

(65) Prior Publication Data

US 2014/0262993 A1 Sep. 18, 2014

(51) Int. Cl.
*E03F 7/10* (2006.01)
*E03F 9/00* (2006.01)

(52) U.S. Cl.
CPC . *E03F 9/00* (2013.01); *E03F 7/10* (2013.01); *E03F 7/103* (2013.01); *E03F 7/106* (2013.01)

(58) Field of Classification Search
None
See application file for complete search history.

(56) References Cited

U.S. PATENT DOCUMENTS 2,303,491 A * 12/1942 Otterson ..... E03F 7/10 210/196
3,765,724 A 10/1973 Hatcher et al.
4,134,174 A 1/1979 Flynn et al.
4,207,647 A 6/1980 Masters
4,322,868 A 4/1982 Wurster
4,525,277 A 6/1985 Poulin
5,435,854 A 7/1995 Derlein
5,547,514 A 8/1996 Ward et al.
5,946,767 A * 9/1999 Sinz ..... B01D 37/00 134/109
6,013,138 A 1/2000 Sinz
7,429,319 B2 * 9/2008 Davis ..... B08B 9/04 134/104.4
7,503,134 B2 * 3/2009 Buckner ..... E01H 1/0827 15/300.1
2013/0043195 A1 2/2013 O'Konek et al.

* cited by examiner

*Primary Examiner* — Terry Cecil
(74) *Attorney, Agent, or Firm* — Merchant & Gould P.C.

(57) ABSTRACT

A sewer cleaning vehicle is disclosed. In one aspect, the sewer cleaning vehicle has a refuse storage tank having a first end with an opening. The sewer cleaning vehicle may also have a recycled water storage tank and a packaged liquid reclamation system for cleaning and transferring water from the refuse tank to the recycled water storage tank. In one embodiment, a hinged cover having a first side and a second side is pivotally mounted to the storage tank. The hinged cover can be movable between a first position in which the hinged cover covers the storage tank opening and a second position in which the storage tank opening is uncovered by the hinged cover. A transfer pump and a separator are supported by the hinged cover and are in fluid communication with the refuse tank through a port in the hinged cover.

9 Claims, 5 Drawing Sheets

PACKAGED LIQUID RECLAMATION SYSTEM

BACKGROUND

Reclamation components mounted at several diverse locations on a sewer cleaning vehicle makes service, maintenance and cleaning difficult and time consuming. Furthermore, reclamation equipment mounted on fixed bases incapable of retracting or swinging out or away from the refuse tank can cause difficult and time consuming service, maintenance and cleaning. This type of fixed mounting of reclamation equipment also increases exposure to sewer materials when servicing the equipment mounted internally when personnel are required to enter the debris tank. Additionally, mounting of reclamation components at several diverse locations on sewer cleaning equipment increases complexity of interconnecting plumbing, utilizes valuable space required for other on-board sewer cleaning equipment and increases system cost. Such a configuration also increases the chance of exposing other on-board equipment to contamination during service and maintenance operations. Where a sewer cleaning vehicle must be retrofitted with a reclamation system, such retrofitting with diversely mounted reclamation equipment increases cost due to multiple mounting attachments and connections required. Improvements in reclamation systems are desired.

SUMMARY

A sewer cleaning vehicle is disclosed. In one aspect, the sewer cleaning vehicle has a refuse storage tank having a first end with an opening. The sewer cleaning vehicle may also have a recycled water storage tank and a packaged liquid reclamation system for cleaning and transferring water from the refuse tank to the recycled water storage tank. In one embodiment, a hinged cover having a first side and a second side is pivotally mounted to the storage tank. The hinged cover can be movable between a first position in which the hinged cover covers the storage tank opening and a second position in which the storage tank opening is uncovered by the hinged cover. A transfer pump can be provided that is supported by the hinged cover on the first side. In one aspect, the transfer pump has an outlet and an inlet in fluid communication with the storage tank via a first inlet port in the hinged cover. A separator may also be provided for cleaning the fluid leaving the refuse tank. In one aspect, the separator is supported by the hinged cover on the first side wherein the separator has an inlet in fluid communication with the transfer pump outlet and a first outlet in fluid communication with the recycled water storage tank.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
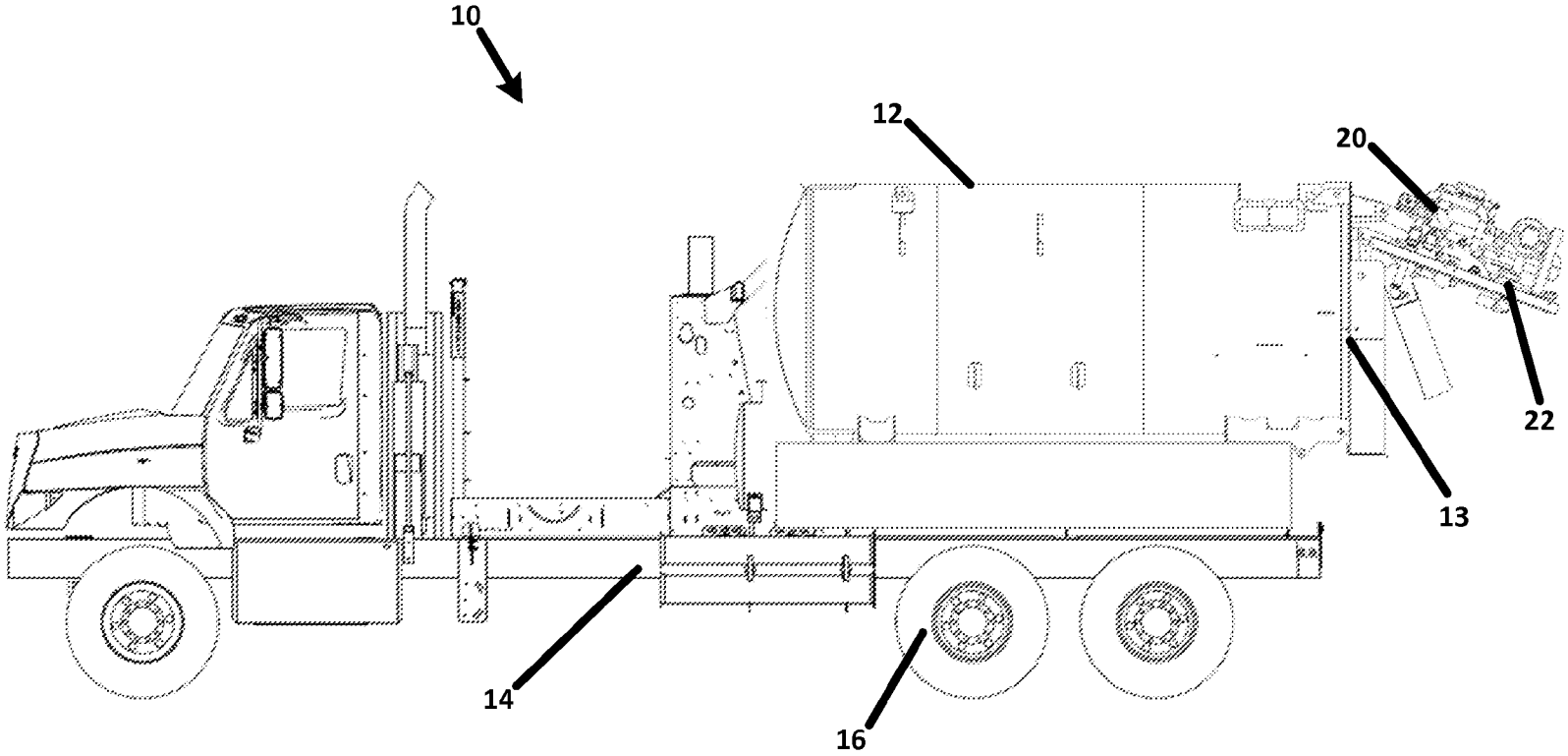
FIG. 1 is a side view of a refuse vehicle with a refuse tank and packaged liquid reclamation system having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring to FIG. 1, a vehicle 10 having a packaged liquid reclamation system 20 is shown. In one embodiment, the vehicle 10 is a sewer cleaning vehicle having a refuse tank 12 for collecting water and debris or refuse from a sewer or other location. As shown, vehicle 10 has a plurality of wheels 16 and a chassis 14 that supports the refuse tank 12.

The packaged liquid reclamation system 20 is for processing refuse water stored in the refuse tank 12 such that the refuse water is cleaned and delivered for use as recycled water. By use of the term "packaged" it is meant to indicate that the constituent components of the liquid reclamation system 20 are in close proximity to each other and supported by a common structure and not distributed in different locations across the vehicle 10.

In the embodiment shown, the packaged liquid reclamation system 20 includes a hinged cover 22 that is pivotally mounted to the refuse tank 12. In a closed position, the hinged cover 22 seals a rear opening 13 of the refuse tank 12 such that refuse water cannot exit through the opening 13. In an open position, which is the position shown in FIGS. 1 and 2, the cover 22 is moved away from the opening 13 such that the contents of the interior of the refuse tank 12 can be dumped or cleared from the tank 12. As a typical cleaning operation will result in the collection of debris or refuse in addition to water, the hinged cover 22 must be openable at least to the extent that the interior of the tank can be accessed for clearing the debris or refuse. In the embodiment shown, the tank 12 can be tilted such that the refuse or debris can be dumped out of the tank 12 through the opening 13 when the hinged door 22 is in the open position.

Figure 3:
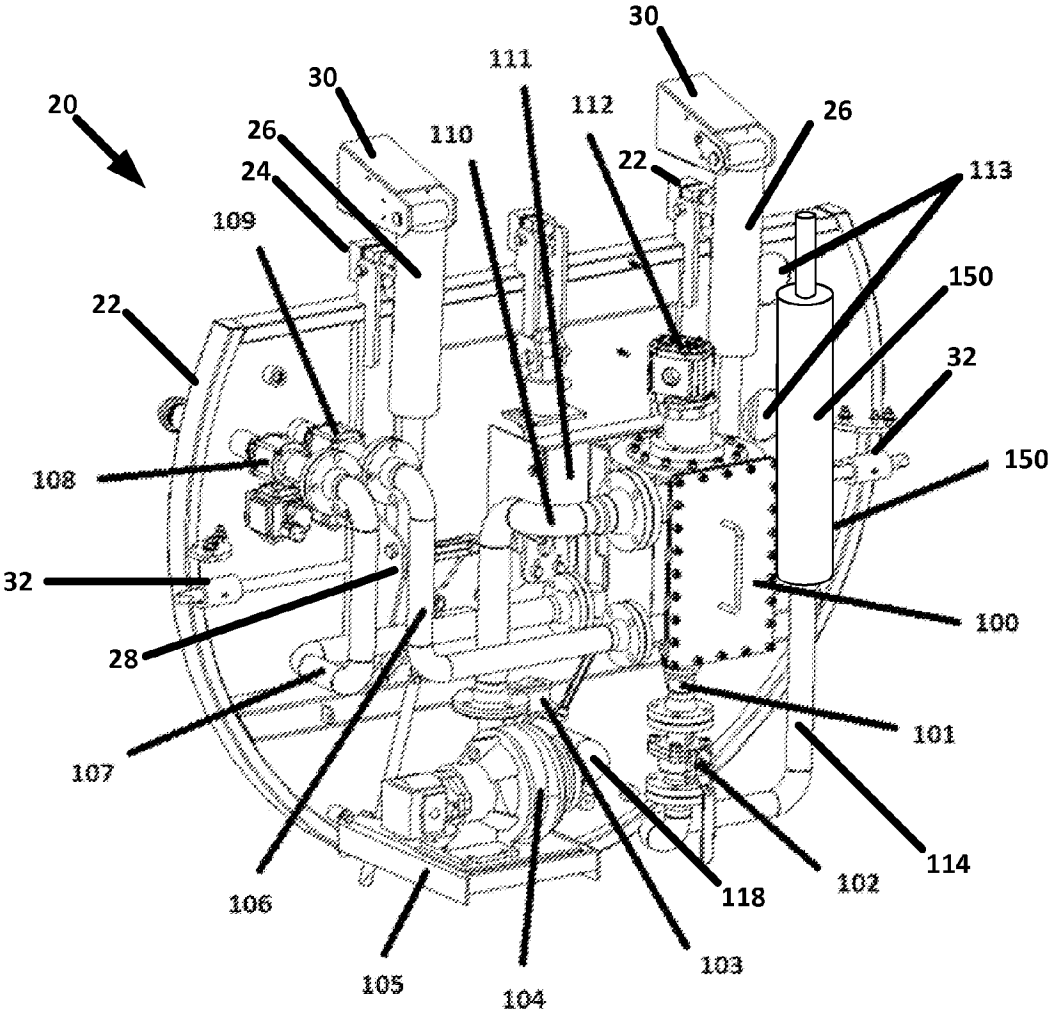
FIG. 3 is a front perspective view of the packaged liquid reclamation system shown in FIG. 1.

As most easily seen at FIG. 3, the hinged cover 22 further includes a pair of hinges 24 that are mounted to the refuse tank 12. The hinges 24 allow the hinged cover 22 to be rotatable with respect to the refuse tank 12. A pair of actuator assemblies 26 is also provided on the hinged cover 22. The actuator assemblies 26 include brackets 28 connected to the hinged cover 22 and brackets 30 that are mounted to the refuse tank 12. Accordingly, the hinges 24, brackets 28, 30, and the cover 22 essentially form four bar type linkages wherein actuation of the actuators will cause the hinged cover 22 to open or close. The hinged cover 22 is also shown as being provided with a locking assembly 32 that includes an actuator and locking bars that lock the hinged cover 22 in the closed position. Other types of hinged connections are possible, as are methods of actuating the hinged cover 22. For example, the hinges and actuators could be disposed on the side of the cover 22 instead of along a top side, as shown.

Figure 2:
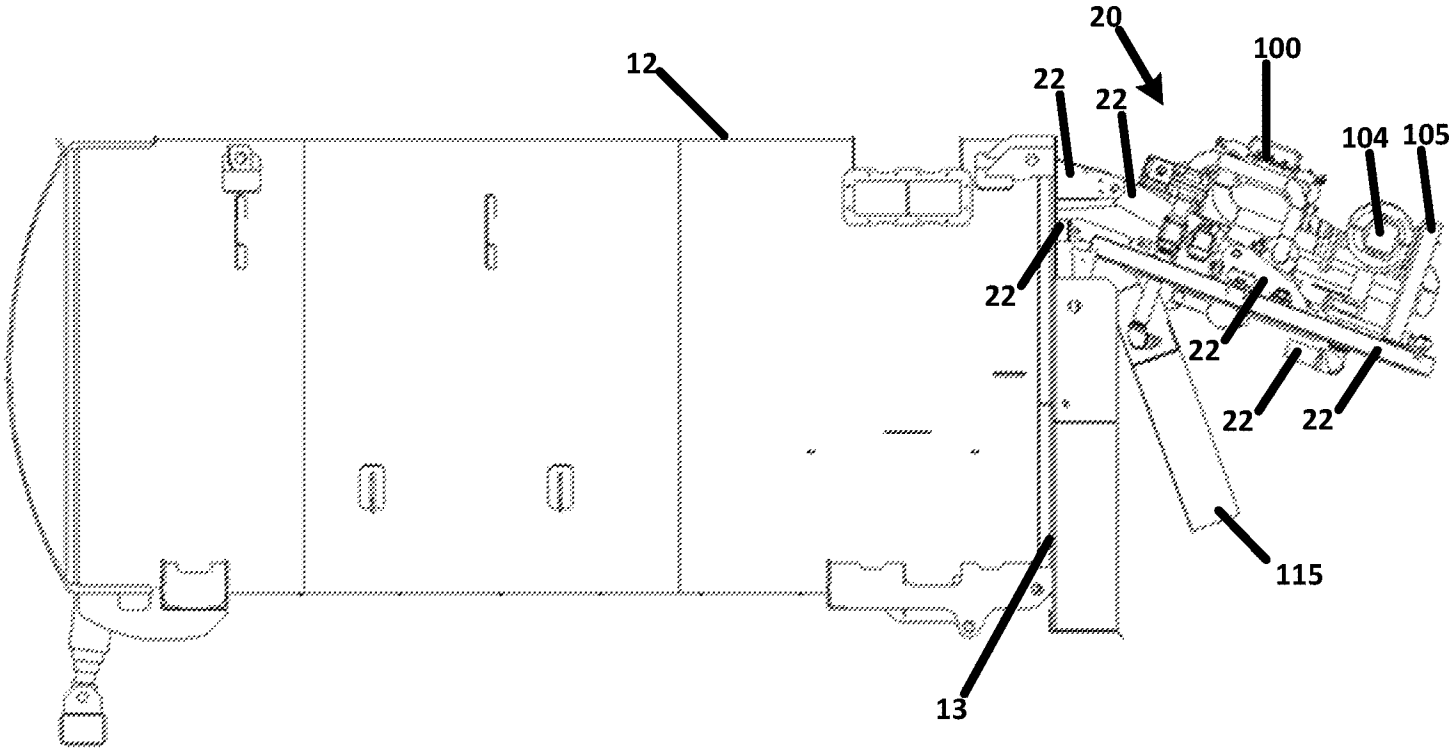
FIG. 2 is a side view of the refuse tank and packaged liquid reclamation system shown in FIG. 1.
Figure 4:
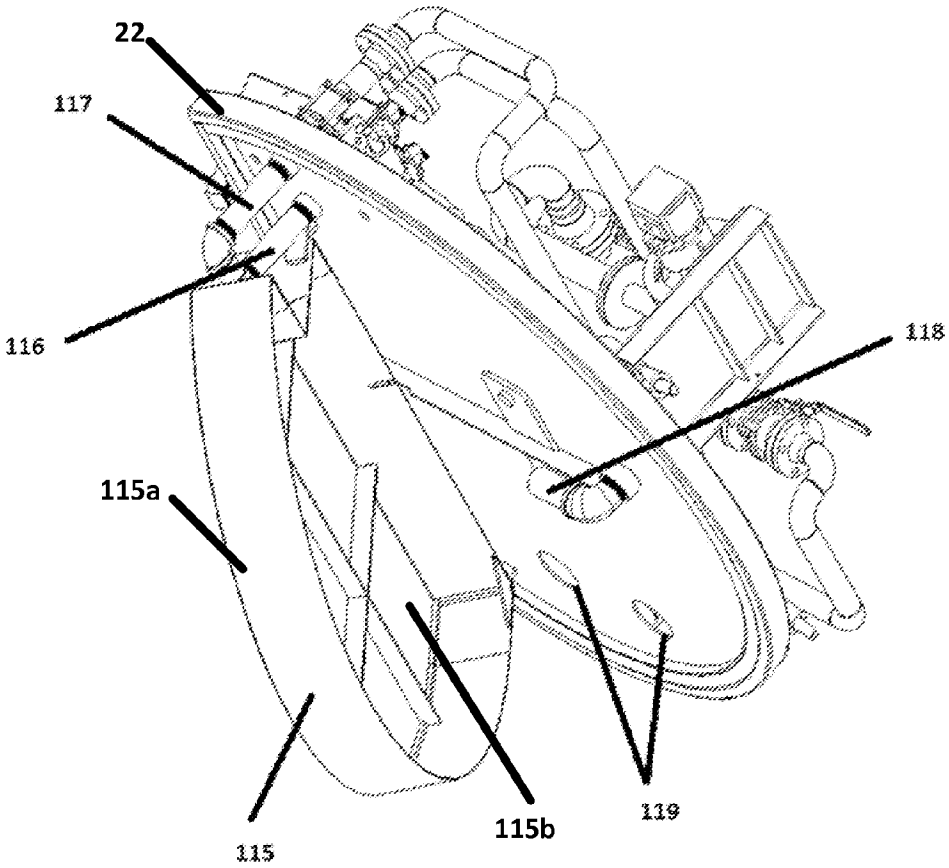
FIG. 4 is a rear perspective view of the packaged liquid reclamation system shown in FIG. 1.

Referring to FIGS. 2-4, the packaged liquid reclamation system 20 is shown in greater detail. As shown, the hinged cover 22 includes a transfer pump 104. In the embodiment shown, the transfer pump 104 is for transporting liquid from the refuse tank 12 through the reclamation system 20 and to a recycled water storage tank 150 (discussed later) or another other end use or device. Many types of pumps may be used for transfer pump 104, such as centrifugal type pumps and positive displacement pumps. As shown, the inlet side of the pump 104 is in fluid communication with the interior of the refuse tank 12 via an inlet port and piping 118.

As shown, the transfer pump 104 is supported by a mounting platform 105. In the embodiment shown, the mounting platform 105 is rigidly attached to the cover 22, but may be placed in a pivotable relationship with respect to the hinged cover 22 or another part of the vehicle 10. However, it should be understood that the mounting platform 105 could be rigid with respect to the hinged cover 22. Furthermore, the platform 105 could be rotatably mounted to another portion of the vehicle other than the hinged cover 22. A control valve 103 is also provided at the inlet of the pump 104 in order to isolate the pump from the refuse tank, when desired. In one embodiment, the control valve 103 is an actuated knife-gate type valve.

The outlet side of the pump 104 is in fluid communication with a separator 100. The filter 100 is for removing debris from the water being removed from the refuse tank 12 by the transfer pump 104. Many types of separators may be utilized, such as filters and strainers. An optional pre-screen 115 may also be provided to reduce the contaminant load on the separator 100. As shown, the pre-screen is rotatably mounted on the hinged cover 22 and is oriented to cover the inlet port 118. Additionally, sidewalls 115*b* are provided on the pre-screen 115 to sufficiently space the pre-screen media 115*b* away from the inlet port 118. The pre-screen media 115*b* may be made from a variety of materials, such as wire mesh.

As most easily seen at FIG. 3, the separator 100 receives the pumped water through an inlet line 110. In operation, at least some of the debris or refuse is separated from the water to result in recycled water. The recycled water exits the separator 100 through outlet piping 101 which shown as being connected to the recycled water storage tank 150 via piping 114. Referring to FIG. 3, it can be seen that the recycled water storage tank 150 can be supported by the cover 22. Between piping 101 and 114, an isolation valve 102 may be provided. Isolation valve 102 may be provided as a manual valve or an actuated valve. In the embodiment shown, valve 102 is a manually operated ball type valve.

The separator 100 may also be placed in communication with an intermittent flush line 106 and a continuous flush line 107, each of which feeds back through ports and inlet piping 116, 117 extending through the hinged cover 22. Intermittent flush line 106 and continuous flush line 107 both serve to remove a build-up of solid materials on the upstream side of the filter media inside of separator 100. As shown, control valves 108, 109 are provided to selectively shut flow on and off through the lines 108, 109. The flush lines 106, 107 recirculate water from separator 100 back into the refuse tank 12. Intermittent flush line 106 functions to return a portion of the unfiltered liquid from separator 100 to refuse tank 12 only during a portion of the separation process. This is accomplished by a controller (not shown) connected to control valve 109 that serves to maintain a constant ratio of valve-open time to valve-closed time, during the separation process. The controller thus maintains a constant duty-cycle for control valve 109 and causes control valve 109 to be opened on an intermittent basis. Continuous flush line 107 functions to return a portion of the unfiltered liquid from separator 100 to refuse tank 12. During the separation process, control valve 108 remains open (continuously) and an orifice (not shown) installed in continuous flush line 107 limits the return flow to refuse tank 12.

A drive motor 112 may also be provided with separator 100. As shown, drive motor 112 is connected to the filter media inside of separator 100 and serves to maintain a constant rotational speed for the filter media.

As shown, the separator 100 is supported by a mounting platform 111. In the embodiment shown, the mounting platform 111 is rigidly attached to the cover 22, but may be placed in a pivotable relationship with respect to the hinged cover 22 or another part of the vehicle 10. However, it should be understood that the mounting platform 111 could be rigid with respect to the hinged cover 22. Furthermore, the platform 111 could be rotatably mounted to another portion of the vehicle other than the hinged cover 22.

In the embodiment shown, the hinged cover 22 can also be provided with liquid level viewing ports 113, 119 in the hinged cover 22 such that an operator can visually verify that the refuse tank 12 has a sufficient water level for operation of the liquid reclamation system 20.

Figure 5:
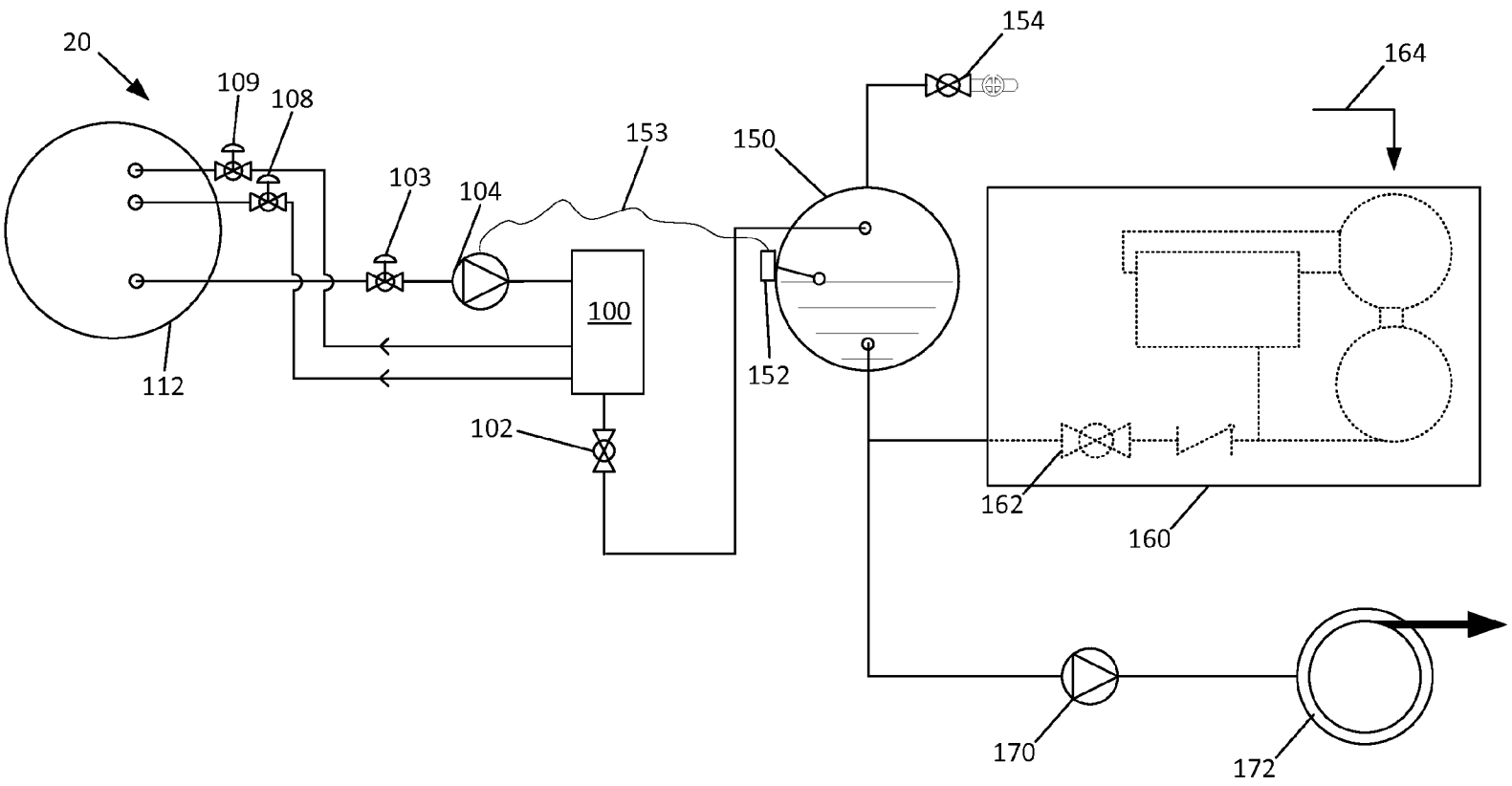
FIG. 5 is a schematic piping diagram of the packaged liquid reclamation system and other systems of the vehicle shown in FIG. 1.

Referring to FIG. 5, a schematic is shown of the liquid reclamation system 20 and the related downstream systems. As related previously, the system can be configured to deliver recycled water to a storage tank 150 where recycled water can be stored until it is needed. As shown, the storage tank 150 is provided with a float switch 152 that can be wired 153 to control the activation of the transfer pump 104 such that the tank 150 is not overfilled by the pump 104. The float switch can be directly wired into a relay in the power circuit for the pump, or an electronic controller can be used with an input from the float switch 152 and an output to the pump 104.

Still referring to FIG. 5, the recycled water tank 150 can also be provided with an overflow valve assembly 154. Overflow valve assembly 154 is for providing pressure relief in the tank 12 in the event the pump 104 over fills and/or over pressurizes the tank 150. A flexible hose (not shown) can be connected to the overflow valve assembly 154 such that any overflow from the tank 150 can be directed to a desired location, such as a street sewer. Also, if the refuse storage tank 12 is becoming full, the liquid reclamation system 20 can easily implement the added function of filtering and pumping off debris-containing liquid to the sewer or pipeline (source) for improved liquid debris body level control during operation. Accordingly, the vehicle can continue a cleaning operation for a longer period of time without having to stop and decant water from tank 12 before continuing further. This function can be performed through a separate hose or piping line or can be implemented with overflow valve assembly 154.

Downstream of the recycled water storage tank 150, a fresh water storage system 160 is shown. By the use of the term "fresh water" it is simply meant to indicate that the water has not already been used in a cleaning operation. The fresh water storage system 160 is for collecting and storing fresh or potable water for use in a cleaning operation. As shown, fresh water storage system 160 is provided with an isolation valve 162 that isolates the fresh water storage system 160 from the piping associated with the recycled water system. Accordingly, valves 102 and 162 can be selectively operated such that only fresh water or only recycled water, or a combination of both, are used in a particular cleaning operation. It is noted that the actuation of valves 102 and 162 can be manual or automatic. Where valves 102, 162 are automatic, a controller or user interface can be used to select the desired mode of operation for the system, and the valves 102, 162 will then be moved by the system into the proper position. The fresh water storage system 160 can be replenished by a fresh water source 164, as needed.

Still referring to FIG. 5, a jetter pump 170 is shown as being in fluid communication with the fresh water storage system 160 and the recycled water storage tank 150. The jetter pump 170 is for providing high pressure water to a hose reel 172 so that a high pressure spraying operation can be performed. Depending upon the position of valves 102, 162, the jetter pump will deliver high pressure recycled water, high pressure fresh water, or a mixture of both recycled and fresh water to the hose reel 172.

The above described packaged liquid reclamation system 20 allows for recycling of water from a single consolidated location and simplifies cleaning and maintenance. Additionally, the modularized mounting of components (e.g. filters and/or strainers, controls, valves, interconnecting hoses and the pump) on hinged swing-out frames or hinged rear door reduces operator exposure to contaminated materials during service, maintenance and cleaning. Therefore, the disclosed configuration simplifies access for the purposes of servicing and cleaning of elements of the system that are either internal or external to the debris-containing tank. For example, opening of the door exposes both internally and externally-mounted elements. This allows service and cleaning without requiring personnel to enter the debris-containing tank.

A great number of additional benefits also result from the disclosed configuration. For example, the disclosed system simplifies access for the purposes of draining the system for freeze protection. The system also allows cleaning and draining locations to be consolidated with the discharge of collected solids and liquids collected in the debris-containing tank. Furthermore, the system provides an easier installation on new and existing sewer cleaning vehicles by simplifying plumbing, reducing lengths of plumbing, and modularity. Also, the system design takes advantage of normally underutilized space available on sewer cleaning vehicles and places components near hinge points across which hoses and plumbing must be routed to allow opening of the door and/or tipping of the tank (if so equipped). Another benefit is that the system increases modularity for the purposes of multiple water reclamation systems working in parallel for higher flow capability and for the purposes of multiple water reclamation systems working in series for reduced particle size in reclaimed water (improved filtration).

Additional benefits are that the number of pumps required in the total system can be reduced while facilitating automation of the liquid level controls. The system also improves productivity by eliminating a time-consuming, additional operation to decant excess liquids collected in the tank. Productivity is also increased by eliminating the close monitoring of the optimum liquid level in the tank with automation of the liquid level control.

Furthermore, it should be appreciated that the packaged liquid reclamation system can be easily used in a retrofit application on an existing vehicle due to the modular or packaged nature of the components. By locating reclamation components on swing out frames and/or on the hinged rear door at the rear of the vehicle, retrofit capability is enhanced as equipment is consolidated and drains, access doors and inspection ports are desirably kept near the discharge point of the debris containment body.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. A sewer cleaning vehicle comprising:

(a) a refuse storage tank having a first end with an opening;

(b) a recycled water storage tank; and (c) a packaged liquid reclamation system including:

i. a hinged cover having a first side and a second side and being pivotally mounted to the refuse storage tank, the hinged cover being movable between a first position in which the hinged cover covers the refuse storage tank opening and a second position in which the refuse storage tank opening is uncovered by the hinged cover;

ii. a transfer pump supported by the hinged cover on the first side, the transfer pump having an outlet and an inlet in fluid communication with the refuse storage tank via a first inlet port in the hinged cover; and iii. a separator supported by the hinged cover on the first side, the separator having an inlet in fluid communication with the transfer pump outlet and a first outlet in fluid communication with the recycled water storage tank.

2. The sewer cleaning vehicle of claim 1, further comprising a pre-screen assembly mounted to the hinged cover on the second side, the pre-screen assembly covering the inlet port on the hinged door.

3. The sewer cleaning vehicle of claim 1, wherein the transfer pump is activated by a float switch located within the recycled water storage tank.

4. The sewer cleaning vehicle of claim 1, wherein the separator has a second outlet in fluid communication with the refuse storage tank via a second inlet port in the hinged cover.

5. The sewer cleaning vehicle of claim 1, wherein the recycled water storage tank includes an overflow valve assembly.

6. The sewer cleaning vehicle of claim 1, further comprising a second pump in fluid communication with the recycled water storage tank, the second pump being for pumping recycled water to a hose reel from the recycled water tank.

7. The sewer cleaning vehicle of claim 6, further comprising a fresh water storage system in fluid communication with the second pump.

8. The sewer cleaning vehicle of claim 1, further comprising a first platform mounted to the hinged door, the first platform being for supporting at least one of the transfer pump and the separator.

9. The sewer cleaning vehicle of claim 8, wherein the first platform is rotatably mounted to the vehicle.

* * * * *